United States Patent [19]

Coefield

[11] 4,179,126

[45] Dec. 18, 1979

[54] CROSSWORD PUZZLE GAME

[76] Inventor: Nina Coefield, 2225 Beech Dr., Great Falls, Mont. 59404

[21] Appl. No.: 916,656

[22] Filed: Mar. 9, 1978

Related U.S. Application Data

[60] Division of Ser. No. 860,512, Dec. 15, 1977, Pat. No. 4,106,773, which is a continuation of Ser. No. 777,877, Mar. 15, 1977, abandoned.

[51] Int. Cl.[2] ..... A63F 9/18

[52] U.S. Cl. ..... 273/240

[58] Field of Search ..... 273/240, 272, 153 R, 273/156; 35/35 R, 35 H

[56] References Cited

U.S. PATENT DOCUMENTS

| | | | |
|---|---|---|---|
| 255,892 | 4/1882 | Silver | 273/240 |
| 2,055,159 | 9/1936 | Scofield | 273/272 |
| 2,157,589 | 5/1939 | Bullen et al. | 273/240 X |
| 3,195,895 | 7/1965 | Kropinski | 273/272 X |
| 3,863,931 | 2/1975 | Forsyth et al. | 273/156 |
| 3,877,703 | 4/1975 | Pierre | 273/272 X |
| 4,014,548 | 3/1977 | Trilling | 273/272 |

FOREIGN PATENT DOCUMENTS

| | | | |
|---|---|---|---|
| 908792 | 10/1962 | United Kingdom | 273/272 |

*Primary Examiner*—Anton O. Oechsle
*Attorney, Agent, or Firm*—John J. Byrne

[57] ABSTRACT

A competitive game played with a crossword puzzle, at least two writing instruments capable of filling in the crossword puzzle in different colors, and a timer. The contestants take turns filling in the crossword puzzle, each contestant using a different one of the writing instruments and the lengths of their turns being measured by the timer. Values are assigned to each square in the crossword puzzle, and the winner of the game is determined at the end of play by adding up the values assigned to each square filled in correctly in each color.

5 Claims, 2 Drawing Figures

CROSSWORD PUZZLE GAME

This is a division of application Ser. No. 860,512, filed Dec. 15, 1977, now U.S. Pat. No. 4,106,773. That application in turn was a continuation of application Ser. No. 777,877, filed Mar. 15, 1977, and now abandoned.

BACKGROUND OF THE INVENTION

This invention relates to a competitive game to be played by two or more individuals or teams. In particular, it relates to a competitive game to be played with a crossword puzzle, at least two writing instruments capable of filling in the crossword puzzle in different colors, and a timer.

The crossword puzzle in its earliest form was derived in 1913 as a nursery game, and the full development of the crossword puzzle in its present form was accomplished by the New York World, which began publishing them in 1923. Crossword puzzles then became an American craze, and by 1930 crossword puzzles were carried by almost every major newspaper in the country as one of their entertainment features. Moreover, the idea quickly spread abroad, particularly to England, where it became an equally popular entertainment.

Crossword puzzles in their traditional form, however, are either a solitary passtime or, at best, a co-operative passtime. They lack the exhileration of competition, and their solution does not make a good spectator sport.

OBJECTS OF THE INVENTION

It is, therefore, a general object of this invention to provide a game in which crossword puzzles may be filled out in a competitive manner and in a fashion which makes their solution a good spectator sport.

It is a further object of the invention to provide a game which can be played at various levels of sophistication, so as to adapt it for play by everyone from five-year-olds to adults who are experts in the solution of crossword puzzles.

It is still another object of the invention to provide a game which is suitable either for home use or, with slight modifications, for use as a televised entertainment.

Other objects and advantages of the present invention will become apparent from the following detailed description of some preferred embodiments thereof taken in conjunction with the accompanying drawings.

THE DRAWINGS

DETAILED DESCRIPTION

Figure 1:
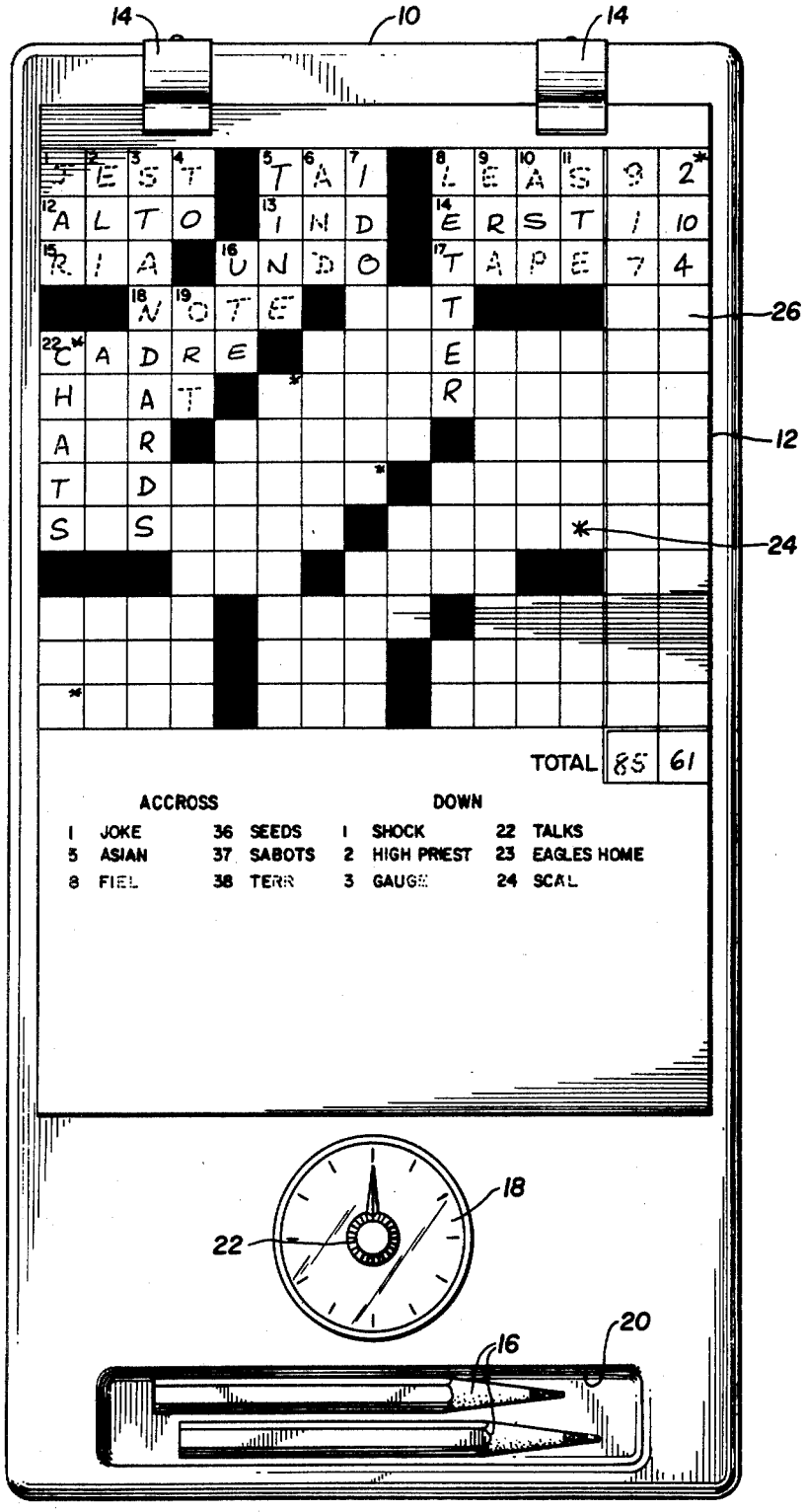
FIG. 1 is a plan view of a preferred embodiment of the subject invention.
Figure 2:
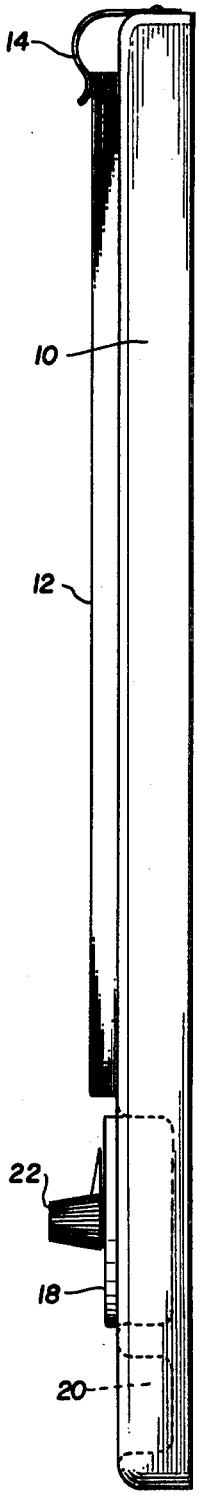
FIG. 2 is a side view of the embodiment shown in FIG. 1.

The apparatus depicted in the drawings comprises a board 10, a pad of crossword puzzles 12, means 14 for releasably attaching the pad of crossword puzzle 12 to the board 10, at least two writing instruments 16 capable of filling in the crossword puzzle in different colors, and a timer 18. It is contemplated that the solutions to each crossword puzzle will be printed on the back thereof and that additional pads of crossword puzzles of varying levels of difficulty and varying subject matter will be available from the manufacturers of the illustrated apparatus.

As shown, the means 14 can comprise a simple spring clip gripping the pad 12 at the top, but alternatively it could comprise posts mounted on the board 10 and adapted to cooperate with holes in the crossword puzzle or many other similar devices. Additionally, it will be appreciated that the apparatus need not essentially comprise means 14 at all.

The writing instruments 16 preferably comprise simply different colored pencils, for which a retention compartment 20 with or without a cover is preferably provided in the board 10. Additionally, the writing instruments 16 can be physically attached to the board 10, as by cords or chains.

The timer 18 is preferably settable at various time intervals, depending on the speed with which the players wish to play the game and, if it is played with handicaps and/or penalties as described hereinafter, the handicap and/or penalty assigned to each player. For instance, the indicia shown on the illustrated timer could represent either 15 or 30 second intervals, and the timer could be set for each turn by means of the knurled knob 22. In addition to providing a visual indication of the end of each turn, preferably the timer 18 also comprises means for making an audible signal when the timer reaches zero.

Having described a preferred embodiment of the apparatus for playing the subject game "at home" (that is, with few or no spectators, as opposed to televised play of the game), I will now describe how the game is played. Basically and in all embodiments of the game, the contestants (who may be either individuals or teams) take turns filling in the crossword puzzle, each contestant using a different one of the writing instruments and the lengths of their turns being measured by the timer. Values are assigned to each square in the crossword puzzle, and the winner of the game is determined at the end of play by adding up the values assigned to each square filled in correctly in each color.

In the simplest embodiment of the game, the lengths of each contestant's turns are equal and are set at a period which is a function of the skill of the contestants and the difficulty of the puzzle. In more sophisticated embodiments of the game, the lengths of each contestant's turns are not equal, but are assigned in accordance with each contestant's predetermined handicap, are a function of the score the contestant has made in one or more previous turns, or both. The latter variation is, of course, particularly suitable for the televised version of the subject game, where computation of each contestant's turn could be made by or under control of the master of ceremonies using sophisticated calculating machines. However, at least a simple feedback loop (such as subtracting 15 seconds from each contestant's turn for each letter less than five which that contestant had filled in on his previous turn) could be used even in the "home" version of the game.

Again in the simplest embodiment of the game, each contestant is permitted to fill in no more than one word during his turn, but alternatively each contestant can be permitted to fill in as many words as he has time to write during his turn. An option related to the latter variation is the provision that any contestant may, during his turn, announce his intention to "shoot the moon"- that is, to finish all the remaining squares in the crossword puzzle during a specified interval (as, for instance, three times the length of an ordinary turn), after which he must do so within the specified interval or lose the game.

In the simplest embodiment of the game, each contestant is allowed to fill in any uncompleted word anywhere on the crossword puzzle during his turn. Ordinarily, however, the game is played with the rule that each word filled in after the first word must include at least one letter previously filled in.

Since the contestants fill in spaces incorrectly from time to time, provision must be made for dealing with such errors. Preferably any contestant who fills in a square incorrectly is assigned a penalty equal to the value assigned to that square when the mistake is discovered. Alternatively, the contestant who made the mistake can be penalized in terms of the time given him during his next turn, as for instance at the rate of thirty seconds for each letterfilled in incorrectly. Of course, once the error is discovered, it is erased or marked out, and any contestant has the opportunity to fill in the correct letter during his next turn.

In the ordinary "home" game, each or all contestants are allowed to see the clues continuously during the game and thus to be preparing for their next turn during their opponent(s) turn(s). In a variation which is particularly suitable for television, however, each contestant is allowed to see the clues only during his turn. During their opponent(s) turn(s), each contestant would have to rely on memory for any preparation for his next turn. However, the clues would be visible, either continuously or at intervals, to the television audience all during each contestant's turn, thereby permitting "audience participation" in the sense that the audience could be trying to solve the puzzle ahead of the contestants and cheering on the contestant of their choice.

As shown in FIG. 1 at 24, at least some but less than all of the squares in the crossword puzzle are preferably differentially marked (as by asterisks, as shown, or by shading) and function as "bonus squares." In the "home" version of the game, these squares are simply assigned higher values than the ordinary squares. For instance, if the ordinary squares are assigned the value one, the bonus squares can be assigned the value five. In the televised version of the game, however, these squares provide natural advertising opportunities. That is, each time a contestant fills in a bonus square, he wins one of the products of the program's sponsor, and the product and/or other advertising of the sponsor is shown at that time.

At the conclusion of the game, which comes either when the puzzle is completed or when no contestant has filled in any square during one round of turns, the total number of squares filled in correctly in each color is determined in order to determine the ranking of the contestants. To aid in this determination, blanks such as blanks 26 shown in FIG. 1 are preferably provided adjacent to the ends of lines of squares in the crossword puzzles. Of course, the blanks need not be located at the right edge of the crossword puzzle as shown. Some blanks may be provided on each side of the crossword puzzle, or the blanks may be provided at the bottom of the columns rather than at the end of the rows, and the language "adjacent to the ends of lines of squares" is intended to encompass any such arrangement. However, it has been found in practice that the blank should be distinctly set off from the body of the crossword puzzle, for instance in the manner illustrated, in order to avoid confusion between the blanks and the body of the crossword puzzle itself.

From the foregoing description of some preferred embodiments of the invention, several advantages which singularly distinguish the subject invention from previously known crossword puzzles or crossword puzzle games will be recognized. Some of those advantages are set forth below. However, while the following list of advantages is believed to be both accurate and representative, it does not purport to be exhaustive.

A particular advantage of the subject game is that it permits crossword puzzles to be filled out in a competitive manner and in a fashion which makes their solution a good spectator sport.

Another advantage of the subject game is that it can be played at various levels of sophistication, so as to adapt it for play by everyone from five-year-olds to adults who are experts in the solution of crossword puzzles.

Still another advantage of the subject game is that it is suitable either for home use or, with slight modifications, for use as a televised entertainment.

Finally, it should be noted that, while the present invention has been illustrated by detailed descriptions of several preferred embodiments thereof, it will be obvious to those skilled in the art that various changes in form and detail can be made therein without departing from the true scope of the invention. For that reason, the invention must be measured by the claim appended hereto and not by the foregoing preferred embodiments.

I claim:

1. Apparatus for playing a competitive game, said apparatus comprising:

(a) a board;

(b) a plurality of sheets having crossword puzzles thereon releasably mounted on said board;

(c) a timer mounted on said board;

(d) at least two writing instruments capable of filling in said crossword puzzles in different colors;

(e) a retention compartment for said writing instruments carried by said board; and (f) each of said sheets having at least two vertical columns or horizontal rows of blanks adjacent the crossword puzzle thereon for entry therein by respective writing instruments of the score achieved by the player using that writing instrument in the associated column or row of the crossword puzzle.

2. The apparatus of claim 1 wherein at least some but less than all of the squares in said crossword puzzles are differentially marked and function as "bonus squares".

3. The apparatus of claim 1 wherein said timer is settable at various time intervals.

4. The apparatus of claim 1 wherein said timer includes means for making an audible signal when the timer reaches zero.

5. Apparatus for playing a competitive game, said apparatus comprising:

(a) a board;

(b) a plurality of sheets having crossword puzzles thereon releasably mounted on said board;

(c) a timer mounted on said board, said timer being settable at various time intervals and including means for making an audible signal when the timer reaches zero;

(d) at least two writing instruments capable of filling in said crossword puzzles in different colors;

(e) a retention compartment for said writing instruments carried by said board;

(f) each of said sheets having at least two vertical columns or horizontal rows of blanks adjacent the crossword puzzle thereon for entry therein by respective writing instruments of the score achieved by the player using that writing instrument in the associated column or row of the crossword puzzle; and (g) at least some but less than all of the squares in said crossword puzzles being differentially marked and functioning as "bonus squares".

* * * * *